US006886924B2

(12) United States Patent
Hasenbein et al.

(10) Patent No.: US 6,886,924 B2
(45) Date of Patent: May 3, 2005

(54) DROPLET EJECTION DEVICE

(75) Inventors: Robert A. Hasenbein, Enfield, NH (US); Paul A. Hoisington, Norwich, VT (US); Andreas Bibl, Sunnyvale, CA (US)

(73) Assignee: Spectra, Inc., Lebanon, NH (US)

( * ) Notice: Subject to any disclaimer, the term of this patent is extended or adjusted under 35 U.S.C. 154(b) by 15 days.

(21) Appl. No.: 10/261,425

(22) Filed: Sep. 30, 2002

(65) Prior Publication Data

US 2004/0061744 A1 Apr. 1, 2004

(51) Int. Cl.[7] ..... B41J 2/085
(52) U.S. Cl. ..... 347/76
(58) Field of Search ..... 347/76, 70–71, 347/68, 65, 54, 40, 24

(56) References Cited

U.S. PATENT DOCUMENTS

| | | | | |
|---|---|---|---|---|
| 4,233,610 A | | 11/1980 | Fischbeck et al. | 347/94 |
| 4,386,358 A | | 5/1983 | Fischbeck | 347/55 |
| 4,730,197 A | * | 3/1988 | Raman et al. | 347/40 |
| 4,835,554 A | | 5/1989 | Hoisington et al. | 347/94 |
| 4,891,654 A | | 1/1990 | Hoisington et al. | 347/40 |
| 5,265,315 A | | 11/1993 | Hoisington et al. | 29/25.35 |
| 5,501,893 A | | 3/1996 | Laermer et al. | 428/161 |
| 5,757,400 A | | 5/1998 | Hoisington | 347/40 |
| 6,385,407 B1 | * | 5/2002 | Inose | 399/24 |
| 6,557,985 B2 | * | 5/2003 | Hosono et al. | 347/70 |

* cited by examiner

*Primary Examiner*—K. Feggins
(74) *Attorney, Agent, or Firm*—Fish & Richardson P.C.

(57) ABSTRACT

A fluid droplet ejection device including a body defining a plurality of fluid paths that each include an inlet including a flow restriction, a pumping chamber, and a nozzle opening communicating with the pumping chamber for discharging fluid droplets. An actuator is associated with each pumping chamber. The pumping chamber has a largest dimension that is sufficiently short and the flow restriction provides sufficient flow resistance so as to provide a fluid droplet velocity and/or volume versus frequency response that varies by less than plus or minus 25% over a droplet frequency range of 0 to 40 kHz. Also disclosed are fluid droplet ejection devices in which the ratio of the inlet flow resistance to the pumping chamber flow impedance is between 0.05 and 0.9, the pumping chamber has a time constant for decay of a pressure wave in the pumping chamber that is less than 25 microseconds.

32 Claims, 2 Drawing Sheets

DROPLET EJECTION DEVICE

BACKGROUND

The invention relates to droplet ejection devices. Inkjet printers are one type of droplet ejection device. In one type of inkjet printer, ink drops are delivered from a plurality of linear inkjet printhead devices oriented perpendicular to the direction of travel of the substrate being printed. Each printhead device includes a monolithic semiconductor body that has an upper face and a lower face and defines a plurality of fluid paths from a source of ink to respective nozzles arranged in a single, central row along the length of the device. The fluid paths are typically arranged perpendicular to the line of nozzles, extending to both sides of the device from the central line of nozzles and communicating with sources of ink along the two sides of the body. Each fluid path includes an elongated pumping chamber in the upper face that extends from an inlet (from the source of ink along the side) to a nozzle flow path that descends from the upper surface to a nozzle opening in the lower-face. A flat piezoelectric actuator covering each pumping chamber is activated by a voltage pulse to distort the piezoelectric actuator shape and discharge a droplet at the desired time in synchronism with the movement of the substrate past the printhead device.

In these devices it is desirable to discharge inkdrops that have the same velocity and the same volume in order to provide a uniform image with high quality.

Each individual piezoelectric device associated with each chamber is independently addressable and can be activated on demand to generate an image. The frequency of delivering ink droplets thus can vary from 0 Hz up to some value at which the inkdrop velocity or volume varies to an unacceptable level.

SUMMARY

In one aspect, the invention features a fluid droplet ejection device including a body defining a plurality of fluid paths that each include an inlet including a flow restriction, a pumping chamber, and a nozzle opening communicating with the pumping chamber for discharging fluid droplets. An actuator is associated with each pumping chamber. The pumping chamber has a largest dimension that is sufficiently short and the flow restriction provides sufficient flow resistance so as to provide a fluid droplet velocity versus frequency response that varies by less than plus or minus 25% over a droplet frequency range of 0 to 40 kHz.

In another aspect, the invention features, in general, a fluid drop ejection device in which the pumping chamber has a largest dimension that is sufficiently short and an inlet flow restriction that provides sufficient flow resistance so as to provide a fluid droplet volume versus frequency response that varies by less than plus or minus 25% over a droplet frequency range of 0 to 40 kHz.

In another aspect, the invention features, in general, a fluid drop ejection device in which the ratio of the inlet flow resistance to the pumping chamber flow impedance is between 0.05 and 0.9.

In another aspect, the invention features, in general, a fluid drop ejection device in which the pumping chamber has a time constant for decay of a pressure wave in the pumping chamber that is less than 25 microseconds.

Preferred embodiments of the invention may include one or more of the following features. The apparatus is preferably used in an inkjet printhead to eject ink droplets. The droplet velocity versus frequency response can vary by less than plus or minus 25% over a droplet frequency range of 0 to 60 kHz, and more preferably varies by less than plus or minus 10% over a droplet frequency range of 0 to 80 kHz. The ink droplet volume versus frequency response can vary by less than plus or minus 25% over a droplet frequency range of 0 to 60 kHz, and more preferably varies by less than plus or minus 10% over a droplet frequency range of 0 to 80 kHz. The ratio of inlet flow resistance to pumping chamber flow impedance can be between 0.2 and 0.8, and more preferably is between 0.5 and 0.7. The time constant decay of a pressure wave in the pumping chamber cam be less than 15 microseconds, and more preferably is less than 10 microseconds.

The body of the droplet ejection device can be a monolithic body, e.g., a monolithic semiconductor body. The body can have an upper face and a lower face, and the pumping chamber can be formed in the upper face, and the body can have a nozzle flow path descending from the pumping chamber to the nozzle opening. The pumping chamber can have a length of 4 mm or less. The pumping chamber can have a length of 3 mm or less, or 2 mm or less in some embodiments. The nozzle flow path can have a length of 1 mm or less, preferably 0.5 mm or less.

In particular embodiments the droplet ejection device can be an inkjet printhead.

Embodiments of the invention may have one or more of the following advantages. The droplet ejection devices can have uniform velocity and/or volume at high droplet formation frequencies and over a wide range of frequencies. The droplet ejection devices can operate reliably at high droplet formation frequencies.

Other advantages and features of the invention will be apparent from the following description of particular embodiments thereof and from the claims.

The details of one or more embodiments of the invention are set forth in the accompanying drawings and the description below. Other features, objects, and advantages of the invention will be apparent from the description and drawings, and from the claims.

DETAILED DESCRIPTION OF A PARTICULAR EMBODIMENT

Figure 1:
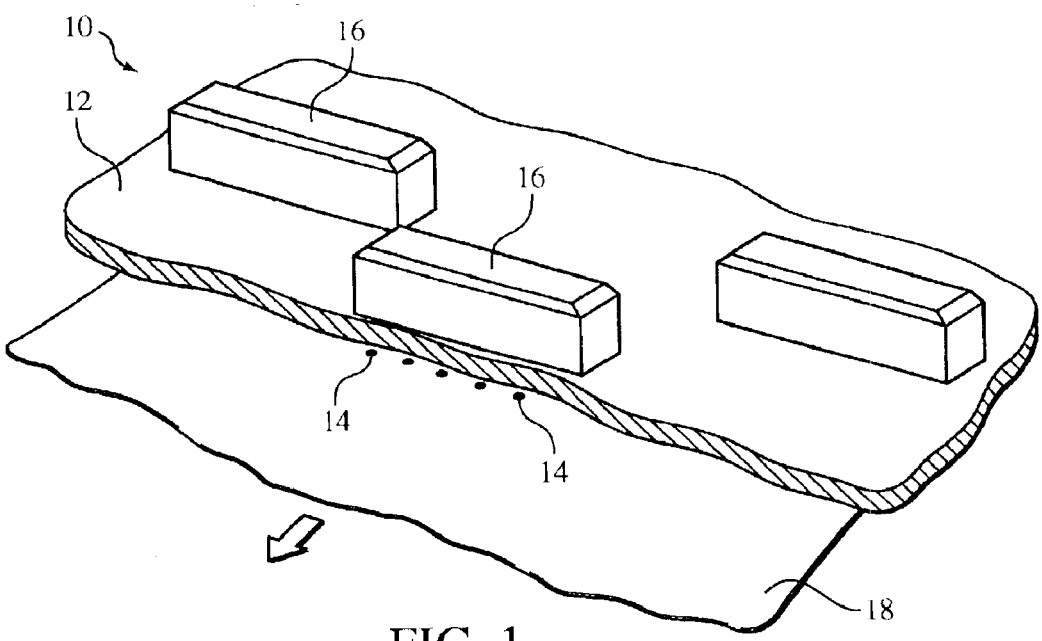
FIG. 1 is a diagrammatic, perspective view of components of an inkjet printer.

Referring to FIG. 1, inkjet printer components 10 include printhead 12, which delivers ink drops 14 from a plurality of linear inkjet printhead devices 16 oriented perpendicular to the direction of travel of the paper 18 being printed. Such a printhead device is described in U.S. patent application Ser. No. 10/189,947, filed Jul. 3, 2002, and entitled "Printhead," which is hereby incorporated by reference.

Figure 2:
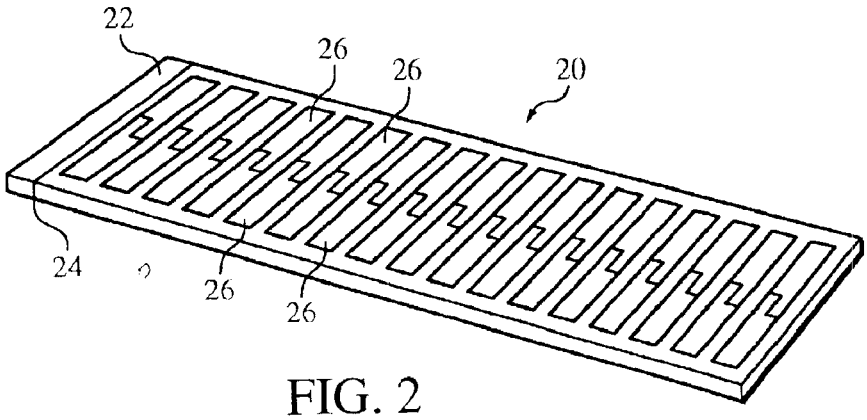
FIG. 2 is a diagrammatic, partial perspective view of a semiconductor body of a printhead device of the FIG. 1 inkjet printer.
Figure 3:
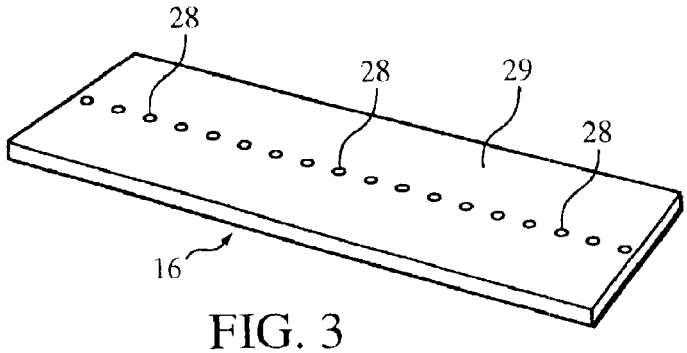
FIG. 3 is a bottom view of a printhead device of the FIG. 1 inkjet printer.

Referring to FIGS. 2 and 3, each printhead device 16 includes a monolithic semiconductor body 20 that has an upper face 22 and a lower face 24 and defines a plurality of fluid paths 26 from a source of ink to respective nozzles openings 28 that are located in orifice plate 29 (FIG. 5) arranged in a single row along the bottom of device 16. The fluid paths are typically arranged perpendicular to the line of nozzle openings 28, extending to both sides of the line of nozzles and communicating with sources of ink at the two sides of the body.

Figure 4:
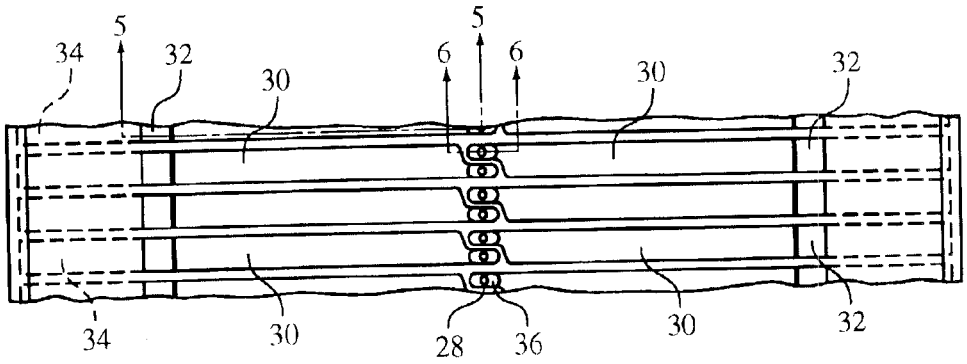
FIG. 4 plan view of a portion of the FIG. 2 semiconductor body.
Figure 5:
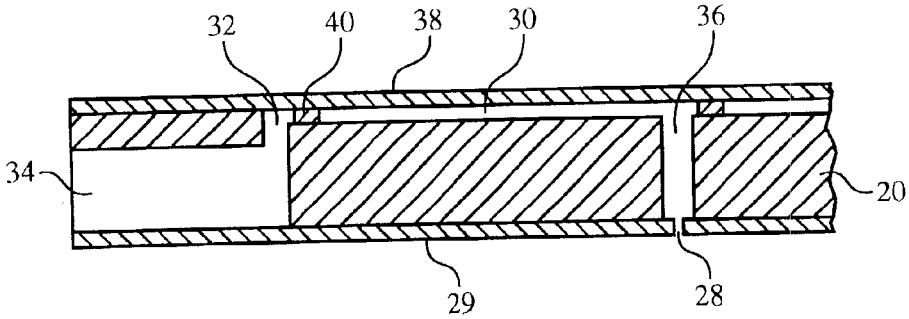
FIG. 5 is a vertical section, taken at 5—5 of FIG. 4, of a portion of the FIG. 2 semiconductor body and associated piezoelectric actuator.

Referring to FIGS. 4 and 5, each fluid path 26 includes an elongated pumping chamber 30 in the upper face that extends from an inlet 32 (from the source of ink 34 along the side) to a nozzle flow path in descender passage 36 that descends from the upper surface 22 to a nozzle opening 28 at the bottom of device 16. A flat piezoelectric actuator 38 covering each pumping chamber 30 is activated by a voltage pulse to distort the piezoelectric actuator shape and thus the volume in chamber 30 and discharge a droplet at the desired time in synchronism with the movement of the paper past the printhead device.

A flow restriction 40 is provided at the inlet 32 to each pumping chamber. As described in the above-referenced application, the flow restriction is provided by a plurality of posts.

Figure 6:
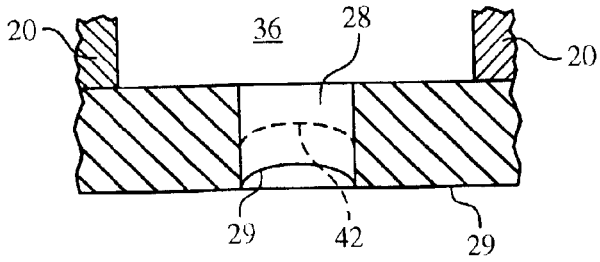
FIG. 6 is a vertical section, taken at 6—6 of FIG. 4, of a bottom portion of the printhead device of the FIG. 1 inkjet printer.

Referring to FIG. 6, the lower boundary of the ink forms a meniscus 40 prior to ejecting a droplet. The meniscus retreats to the position 42 shown in phantom immediately after ejecting a droplet and ideally returns to the position for meniscus 40 prior to ejecting the next droplet.

As the frequency of pumping activation increases, residual pressure waves, which can affect the operation of the pump, can be generated. In particular, the uniformity of droplet volume and/or velocity can vary beyond acceptable levels as higher operating frequencies are approached, limiting the operating frequency of the device.

In inkjet printhead devices 16, the geometry of pumping chamber 30 and the flow resistance provided by flow restriction 40 are controlled to provide damping to reduce reflected waves and reduce formation of residual pressure waves and provide more uniform droplet volume and velocity over a wide range of operating frequencies.

In particular, the length of the pumping chamber 30 is kept below 4 mm, and preferably is less than 3 mm. For an embodiment designed to provide a 30 ng droplet mass, pumping chamber 30 is 2.6 mm long. For an embodiment designed to provide a 10 ng droplet mass, pumping chamber 30 is 1.85 mm long. In both embodiments, pumping chamber 30 is 0.210 mm to 0.250 mm wide and 0.05 mm to 0.07 mm deep and descender passage 36 is 0.45 mm long. Providing a reduced pumping chamber length provides a reduced fluid flow path length and thus an increased resonant frequency. Reducing the nozzle flow path length is also beneficial. The embodiment providing a 30 ng droplet mass maintains drop volume ±10% for frequencies up to 70 kHz, and the embodiment providing a 10 ng droplet mass maintains drop volume ±10% for frequencies up to 100 kHz.

The ratio of the pumping chamber flow impedance and the inlet flow resistance is also controlled to reduce the amplitude of reflected pressure waves at the same time as avoiding too much inlet flow resistance such that it would take too long for the meniscus to recover (see positions for retreated meniscus 40 and recovered meniscus 42 in FIG. 6) when operating at high frequencies. In particular the ratio of inlet flow resistance to pumping chamber flow impedance is between 0.04 and 0.9 (preferably between 0.2 and 0.8, and most preferably between 0.5 and 0.7). Flow restriction 40 can have a flow resistance of $2.5\times10^{12}$ pa-sec/m$^3$ to $1.5\times10^{13}$ pa-sec/m$^3$, and chamber 30 can have a flow impedance of $1.0\times10^{13}$ pa-sec/m$^3$ to $7\times10^{13}$pa-sec/m$^3$. Flow resistance and pumping chamber impedance can be determined using known formulas for simple geometries, e.g., as described in U.S. Pat. Nos. 4,233,610 and 4,835,554. For complex geometries, it is best to determine the resistance and impedance by modeling using fluid dynamic software, such as Flow 3D, available from Flow Science Inc., Santa Fe, N.Mex. The fluid dynamic software determines the resistance and impedance from the geometry of the inlet and pumping chamber and from fluid properties. In an inkjet printhead, where the fluid is ink, typical values of viscosity are 10–25 centipoise, though values could range from 3 to 50 centipoise. Inkjet print heads are typically designed for use with an ink having a viscosity that is ±10 or ±20% with respect to a nominal value. Density of ink is typically around 1.0 gm/cc, and can vary from 0.9 to 1.05 gm/cc. The speed of sound in ink in a channel might vary from 1000 m/s to 1500 m/s.

The time constant for decay of a pressure wave in pumping chamber 30 is also controlled to permit uniform droplet volume and velocity at high frequencies. The time constant for the decay of a pressure wave in a flow channel can be calculated from the flow channel resistance, area, length and fluid properties. The time constant is calculated from a damping factor "Damp" (a dimensionless parameter) for the channel and from the natural frequency for a pressure wave in the channel. The damping factor approximates the fraction of a pressure wave that will decay due to fluidic resistance during one round trip of the reflected wave in the channel. The damping factor is derived from the calculation of the displaced fluid as a pressure wave travels down the fluid channel:

$$\text{Damp}=\text{Resistance}*\text{Csound}*\text{Area}/\text{Bmod}$$

where:

Resistance is the pressure drop for a given amount of flow (pa-sec/m$^3$, for example), Csound is the actual speed of sound in the channel (m/s), Area is the cross-sectional area of the channel (m$^2$), and Bmod is the bulk modulus of the fluid (pa) and is equal to density*Csound$^2$.

The natural frequency of a pressure wave, which is the time it takes for a pressure wave to make a complete round trip in the flow channel, can be calculated from the speed of sound and length of the channel as follows:

$$\text{Omega}=2\pi*\text{Csound}/(2*\text{Length})$$

where:

Length is the largest dimension of the pumping chamber, e.g., the length of the channel for an elongated chamber, in meters.

The time constant (Tau) for the decay of the pressure wave in the channel is then calculated from the damping ratio and the riatural frequency as follows:

$$\text{Tau}=1/(\text{Omega}*\text{damping})$$

The time constant for decay of the pressure wave in the pumping chamber should be less than 25 microseconds, and preferably less than 15 microseconds (most preferably less than 10 microseconds).

Piezoelectric actuator 38 is 2–30 microns (preferably 15–20, e.g., 15 microns) thick. The use of a thin actuator provides a large actuator deflection and ink displacement, permitting a reduced area (and thus reduced length) for pumping chamber 30 for a given droplet volume.

Other embodiments of the invention are within the scope of the appended claims. E.g., other types of inkjet pumping chambers such as a matrix style jet as described in U.S. Pat. No. 5,757,400 can be used, and other droplet ejection devices can be used. Other types of liquids can also be ejected in other types of droplet ejection devices.

What is claimed is:

1. A fluid droplet ejection device comprising:

a body defining a plurality of fluid paths, each said fluid path including an inlet including a flow restriction, a pumping chamber, and a nozzle opening communicating with said pumping chamber for discharging fluid droplets therefrom, and an actuator associated with each said pumping chamber, wherein said pumping chamber has associated dimensions including a largest dimension, said largest dimension being sufficiently short and said flow restriction providing sufficient flow resistance so as to provide a fluid droplet velocity versus frequency response that varies by less than plus or minus 25% over a droplet frequency range of 0 to 40 kHz.

2. The droplet ejection device of claim 1 wherein said fluid droplet velocity versus frequency response varies by less than plus or minus 25% over a droplet frequency range of 0 to 60 kHz.

3. The droplet ejection device of claim 1 wherein said fluid droplet velocity versus frequency response varies by less than plus or minus 10% over a droplet frequency range of 0 to 80 kHz.

4. The droplet ejection device of claim 1 wherein said body has an upper face and a lower face, and said pumping chamber is formed in said upper face extending along a longitudinal axis from a first end at said inlet to a second end, and wherein said body has a nozzle flow path descending from said second end of said pumping chamber to said nozzle opening.

5. A fluid droplet ejection device comprising:

a body defining a plurality of fluid paths, each said fluid path including an inlet including a flow restriction comprising a plurality of posts, a pumping chamber, and a nozzle opening communicating with said pumping chamber for discharging fluid droplets therefrom, and an actuator associated with each said pumping chamber, wherein said pumping chamber has associated dimensions including a largest dimension, said largest dimension being sufficiently short and said flow restriction providing sufficient flow resistance so as to provide a fluid droplet volume versus frequency response that varies by less than plus or minus 25% over a droplet frequency range of 0 to 40 kHz.

6. The droplet ejection device of claim 5 wherein said fluid droplet volume versus frequency response varies by less than plus or minus 25% over a droplet frequency range of 0 to 60 kHz.

7. The droplet ejection device of claim 5 wherein said fluid droplet volume versus frequency response varies by less than plus or minus 10% over a droplet frequency range of 0 to 80 kHz.

8. The droplet ejection device of claim 5 wherein said body has an upper face and a lower face, and said pumping chamber is formed in said upper face extending along a longitudinal axis from a first end at said inlet to a second end, and wherein said body has a nozzle flow path descending from said second end of said pumping chamber to said nozzle opening.

9. A fluid droplet ejection device comprising:

a body defining a plurality of fluid paths, each said fluid path including an inlet including a flow restriction, a pumping chamber, and a nozzle opening communicating with said pumping chamber for discharging fluid droplets therefrom, and an actuator associated with each said pumping chamber, wherein said pumping chamber has a pumping chamber flow impedance and said inlet has an inlet flow resistance, and wherein said pumping chamber and said inlet have associated dimensions so that the ratio of inlet flow resistance to pumping chamber flow impedance is between 0.05 and 0.9.

10. The droplet ejection device of claim 9 wherein the ratio of inlet flow resistance to pumping chamber flow impedance is between 0.2 and 0.8.

11. The droplet ejection device of claim 9, wherein the ratio of inlet flow resistance to pumping chamber flow impedance is between 0.5 and 0.7.

12. The droplet ejection device of claim 9 wherein said body has an upper face and a lower face, and said pumping chamber is formed in said upper face extending along a longitudinal axis from a first end at said inlet to a second end, and wherein said body has a nozzle flow path descending from said second end of said pumping chamber to said nozzle opening.

13. The droplet ejection device of claim 7, 8 or 12 wherein said pumping chamber has a time constant for decay of a pressure wave in the pumping chamber that is less than 25 microseconds.

14. A fluid droplet ejection device comprising:

a body defining a plurality of fluid paths, each said fluid path including an inlet including a flow restriction, a pumping chamber, and a nozzle opening communicating with said pumping chamber for discharging fluid droplets therefrom, and an actuator associated with each said pumping chamber, wherein said pumping chamber has associated dimensions so that said pumping chamber has a time constant for decay of a pressure wave in the pumping chamber that is less than 25 microseconds.

15. The droplet ejection device of claim 1, 5, 9 or 14 wherein said body is a monolithic body.

16. The droplet ejection device of claim 1, 5, 9 or 14 wherein said body is a semiconductor body.

17. The droplet ejection device of claim 1, 5, 9 or 14 wherein said body is a monolithic semiconductor body.

18. The droplet ejection device of claim 14 wherein said body has an upper face and a lower face, and said pumping chamber is formed in said upper face extending along a longitudinal axis from a first end at said inlet to a second end, and wherein said body has a nozzle flow path descending from said second end of said pumping chamber to said nozzle opening.

19. The droplet ejection device of claim 4, 8, 12 or 18 wherein said pumping chamber has a length along said longitudinal axis of 4 mm or less.

20. The droplet ejection device of claim 4, 8, 12 or 18 wherein said pumping chamber has a length of 3 mm or less.

21. The droplet ejection device of claim 4, 8, 12 or 18 wherein said pumping chamber has a length of 2 mm or less.

22. The droplet ejection device of claim 4, 8, 12 or 18 wherein said nozzle flow path has a length of 1 mm or less.

23. The droplet ejection device of claim 4, 8, 12 or 18 wherein said nozzle flow path has a length of 0.5 mm or less.

24. The droplet ejection device of claim 8, 12 or 18 wherein said pumping chamber has associated dimensions including a largest dimension, said largest dimension being sufficiently short and said flow restriction providing sufficient flow resistance so as to provide a fluid droplet velocity versus frequency response that varies by less than plus or minus 25% over a droplet frequency range of 0 to 40 kHz.

25. The droplet ejection device of claim 4, 12 or 18 said pumping chamber has associated dimensions including a largest dimension, said largest dimension being sufficiently short and said flow restriction providing sufficient flow resistance so as to provide a fluid droplet volume versus frequency response that varies by less than plus or minus 25% over a droplet frequency range of 0 to 40 kHz.

26. The droplet ejection device of claim 4, 8 or 18 wherein said pumping chamber has a pumping chamber flow impedance and said inlet has an inlet flow resistance, and wherein the ratio of inlet flow resistance to pumping chamber flow impedance is between 0.05 and 0.9.

27. The droplet ejection device of claim 14 wherein said time constant decay of a pressure wave in the pumping chamber is less than 15 microseconds.

28. The droplet ejection device of claim 14 wherein said time constant decay of a pressure wave in the pumping chamber is less than 10 microseconds.

29. An inkjet printhead comprising:

a monolithic semiconductor body having an upper face and a lower face, the body defining a plurality of fluid paths, each said fluid path including an inlet including a flow restriction, an elongated pumping chamber in said upper face extending along a longitudinal axis from a first end at said inlet to a second end, a nozzle flow path descending from said second end of said pumping chamber, and a member providing a nozzle opening at said lower face communicating with said nozzle flow path for discharging ink droplets therefrom, and a piezoelectric actuator associated with each said pumping chamber, wherein said pumping chamber is sufficiently short along said longitudinal axis and said flow restriction provides sufficient flow resistance so as to provide a ink droplet velocity versus frequency response that varies by less than plus or minus 25% over a droplet frequency range of 0 to 60 kHz.

30. An inkjet printhead comprising:

a monolithic semiconductor body having an upper face and a lower face, the body defining a plurality of fluid paths, each said fluid path including an inlet including a flow restriction comprising a plurality of posts, an elongated pumping chamber in said upper face extending along a longitudinal axis from a first end at said inlet to a second end, a nozzle flow path descending from said second end of said pumping chamber, and a member providing a nozzle opening at said lower face communicating with said nozzle flow path for discharging ink droplets therefrom, and a piezoelectric actuator associated with each said pumping chamber, wherein said pumping chamber is sufficiently short along said longitudinal axis and said flow restriction provides sufficient flow resistance so as to provide a ink droplet volume versus frequency response that varies by less than plus or minus 25% over a droplet frequency range of 0 to 60 kHz.

31. An inkjet printhead comprising:

a monolithic semiconductor body having an upper face and a lower face, the body defining a plurality of fluid paths, each said fluid path including an inlet including a flow restriction, an elongated pumping chamber in said upper face extending along a longitudinal axis from a first end at said inlet to a second end, a nozzle flow path descending from said second end of said pumping chamber, and a nozzle opening at said lower face communicating with said nozzle flow path for discharging ink droplets therefrom, and a piezoelectric actuator associated with each said pumping chamber, wherein said pumping chamber has a pumping chamber flow impedance and said inlet has an inlet flow resistance, and wherein said pumping chamber and said inlet have associated dimensions so that the ratio of inlet flow resistance to pumping chamber flow impedance is between 0.5 and 0.9.

32. An inkjet printhead comprising:

a monolithic semiconductor body having an upper face and a lower face, the body defining a plurality of fluid paths, each said fluid path including an inlet including a flow restriction, an elongated pumping chamber in said upper face extending along a longitudinal axis from a first end at said inlet to a second end, a nozzle flow path descending from said second end of said pumping chamber, and a nozzle opening at said lower face communicating with said nozzle flow path for discharging ink droplets therefrom, and a piezoelectric actuator associated with each said pumping chamber, wherein said pumping chamber has associated dimensions so that said pumping chamber has a time constant for decay of a pressure wave in the pumping chamber that is less than 25 microseconds.

* * * * *